United States Patent [19]

Kramer

[11] 3,942,225

[45] Mar. 9, 1976

[54] SUPPORTING BUTTON FOR ARTICLES OF LUGGAGE, ETC.

[76] Inventor: Hyman Kramer, 1457 Bassett Ave., Bronx, N.Y. 10461

[22] Filed: Oct. 8, 1974

[21] Appl. No.: 513,059

[52] U.S. Cl. ..... 24/94; 190/18 R
[51] Int. Cl.[2] ..... A44B 1/42; A45C 5/00
[58] Field of Search ..... 24/153 LS, 90 B, 90 F, 24/90 PR, 94; 190/18 R; 227/51, 55

[56] References Cited

UNITED STATES PATENTS

| | | | |
|---|---|---|---|
| 91,083 | 6/1869 | Capewell | 24/94 |
| 236,395 | 1/1881 | Colton | 24/90 PR |
| 486,527 | 11/1892 | Beard | 190/18 R UX |
| 496,155 | 4/1893 | Hall | 24/94 |
| 650,212 | 5/1900 | Wooster | 24/94 |
| 754,125 | 3/1904 | Capewell | 24/90 PR |
| 1,383,591 | 7/1921 | Angle | 24/90 PR |
| 1,403,476 | 1/1922 | Axelman | 190/18 R UX |
| 2,662,619 | 12/1953 | Zweigbaum | 190/18 R X |
| 3,771,199 | 11/1973 | Eldringhoff | 24/90 B X |

FOREIGN PATENTS OR APPLICATIONS

| | | | |
|---|---|---|---|
| 807,626 | 10/1936 | France | 24/94 |
| 1,159,495 | 2/1958 | France | 24/90 PR |
| 697,805 | 11/1965 | Italy | 24/90 PR |

*Primary Examiner*—Donald A. Griffin
*Attorney, Agent, or Firm*—J. Harold Kilcoyne

[57] ABSTRACT

A supporting button for attachment to the bottom of an article of luggage, a hand-carried case, a golf bag, etc., and which functions to support said article etc. bottom slightly raised from a surface on which it is rested comprising a generally semi-spherical or other appropriately shaped hollow shell having a axially disposed opening and which is adapted to be secured hollow-side against said article bottom by a rivet which extends axially through the shell and which comprises a head of larger diameter than that of said shell opening and an elongate shank terminating in a bifurcated end-length portion, said shell adjacent its said opening and said rivet shank in its length portion adjacent its said larger diameter head being provided with coacting means which immovably interlock one with the other upon said rivet shank being forced through said central opening to a depth such that the rivet head bears on said shell external surface.

8 Claims, 8 Drawing Figures

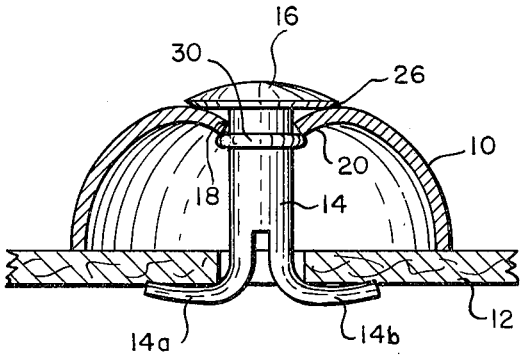
Fig. 1
Fig. 2
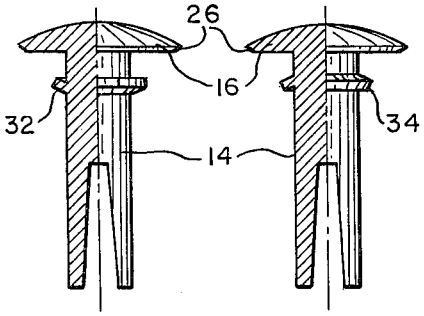
Fig. 3
Fig. 4
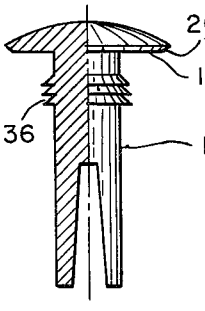
Fig. 5
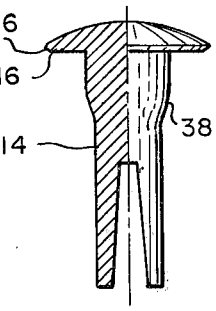
Fig. 6
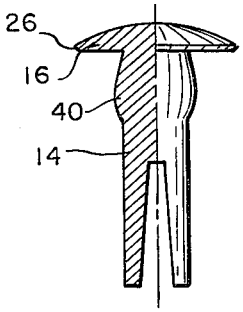
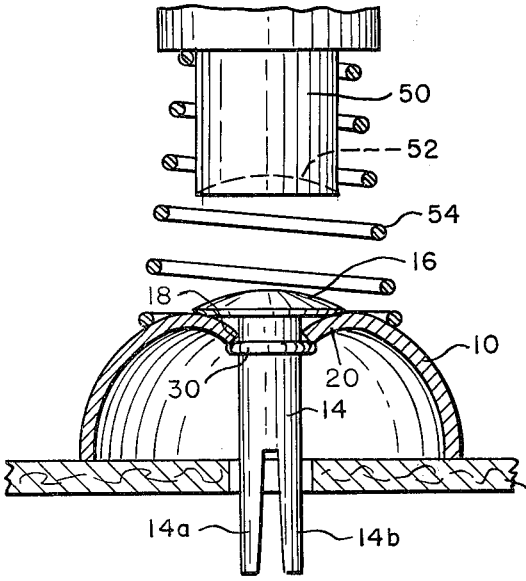
Fig. 7
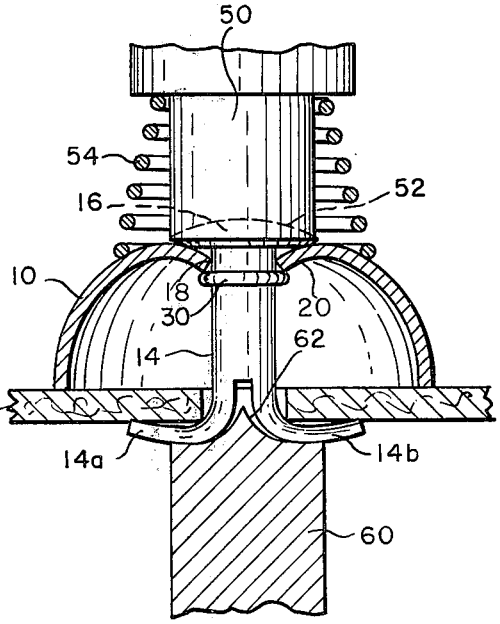
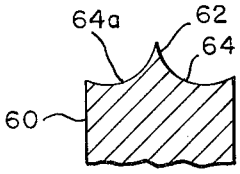
Fig. 8

SUPPORTING BUTTON FOR ARTICLES OF LUGGAGE, ETC.

INTRODUCTION

This invention relates to improvements in supporting buttons for articles of luggage, hand-carried cases, golf bags and the like, which serve to support by their direct engagement with the usually horizontal surfaces on which said articles of luggage, cases or bags are rested, the bottoms or bottom-facings thereof out of direct contact with such surfaces.

BACKGROUND OF THE INVENTION

Supporting buttons for attachment to the bottoms of articles of hand-carried luggage, cases, golf bags and the like which are usually rested on horizontal surfaces and which serve to maintain the bottom or bottom-facings thereof raised slightly above and hence out of direct contact with said surfaces are well known. However, present-day supporting buttons which as conventionally manufactured combine a centrally apertured, hollow, generally semi-spherical inverted metal shell and a headed rivet or stud passed through the aperture thereof and whose end distal from its head is prepared for clinching or being otherwise upset following its passage through the material of the luggage or bag bottom facing, are open to various objections, principal of which is the lack of effective provision for securing the hollow metal shell to the shank of the rivet following assembly thereof on said shank. Yet another objectionable feature of the known supporting buttons stems from the fact that, when said distal end of the rivet shank which is to be clinched or upset as aforesaid was split or otherwise prepared for upsetting, said end lost its original circularity, with the result that the operation of forcing same through the material of the luggage or bag bottom or even through a predrilled circular hole provided therein, sometimes proved either difficult of attainment or could result in attachment of said button with less than the desired maximum security.

THE INVENTION - IN GENERAL

According to the present invention, the first of the aforesaid objectionable features characterizing present-day (known) supporting buttons is overcome (a) by so shaping the hollow-shell component of the button throughout its annular area which extends about and defines its central or axial opening through which passes the shank of the rivet component of the button, as to impart to said annular area the ability of functioning in manner similar to a truncated conical spring, should attempt be made or force applied thereto in direction as tends to disassemble (withdraw) the rivet from the shell; and (b) by providing the rivet component of the button in the short-length portion of its shank which, upon rivet-to-shell assembly being effected is disposed just axially-inwardly of said annular area, with one or more circular formations having diameter which is slightly oversize with respect to the diameter of said central opening of the shell and which are shaped and positioned so as to lockingly coact with the edge of said central opening.

The second feature of objection to the prior supporting buttons, namely, that of the length portion of the shank of the rivet component thereof distal from its head end losing circularity when slitted or bifurcated as is necessary to said end portion being clinched to a luggage- or bag-bottom member, is overcome according to the herein invention by re-shaping the bifurcated end portion of the rivet shank back to its initial circular shape following the slitting or bifurcating operation. Such re-shaping step may be and preferably is performed at the same time and in the same machine as that which fashions the aforesaid oversize circular formation or formations in the shank portion of the rivet.

THE INVENTION - DETAILED DESCRIPTION

The invention will now be described in detail, reference being had to the accompanying illustrative drawing views, wherein;

FIG. 1 is an enlarged section taken on a vertical mid-plane cutting therethrough of a supporting button according to my present invention shown as affixed by clinching to a horizontal member, such as the bottom or bottom wall of an article of luggage, or the bottom of a hand-carried case, or the bottom of a golf bag, for example;

FIGS. 2, 3, 4, 5 and 6 are views illustrating alternate physical shapes and/or formations which the means provided on the rivet shank-portion for interlocking with the edge of the central opening of the shell component of a supporting button may take, according to the present invention; and FIGS. 7 and 8 are partial vertical-plane section views which illustrate a preferred procedure and the means employed in upsetting or clinching the bifurcated ends of the rivet component of a previously assembled support button as herein proposed, as effects affixing of the button in place to a bag or case bottom member or wall.

In said drawing views, wherein FIGS. 1, 7 and 8 for convenience and clarity show the button of the invention, turned 180° from a position which it would normally assume "in use", and FIGS. 2–6 inclusive show alternative forms of the rivet component of the button in correspondingly inverted positions, a supporting button as herein proposed comprises a hollow, preferably semi-spherical, hard-metal shell 10 secured hollow-side down against the outer (upper) surface or facing of a horizontal broken-away part 12 representative of the bottom structural member of an article of luggage, a hand-carried case, a golf-bag, etc. by a rivet 14 whose shank-end portion distal from its head end 16 is shown to have been diametrically slitted so as to terminate in bifurcations designated 14*a*, 14*b*, which as seen in FIGS. 1 and 8, after having been projected through the member 12, were forcibly turned in opposite directions thereby clinching the button as an entity to said member 12.

The rivet shank extends through an axial opening 18 of the aforesaid shell component, which opening is bounded by an annular area designated 20 which, in the inverted position of the supporting button in which it is shown, curves inwardly and relatively downwardly from the body of the shell and hence along a curvature which is generally the reverse of that of said shell body. Stated otherwise, whereas the curvature of said shell body 10 (in the inverted position of the button in which it is shown), is gently upwardly and inwardly, the curvature of said annular area 20 thereof is sharply inward and downward. Thus, said annular area 20 is endowed with the ability to function much as a truncated conical spring, should force be applied in relatively upward direction tending to enlarge the central opening 18 bounded by said annular area 20.

The drawing views also illustrate that the aforesaid head 16 of the rivet component of the supporting button is full-circular in plan and that said head has diameter which is substantially greater than that of the central opening 18 of the shell component through which the rivet shank portion passes. While the under surface of the rivet head 16 may be formed generally conical and complementary to the coning of the annular shell area 20 which bounds said central opening 18, the under surface of said rivet head is preferably planar as shown. Thus, when the rivet is finally and fully assembled to the shell, the head of the rivet will bear on the shell outer-surface along a circular line or zone which is spaced relatively upwardly-axially (FIG. 1) from the edge of the axial opening 18 of the shell. To insure what may be termed broad-band or zone-seating of rivet head on shell, the outer peripheral edge of the rivet head is chamfered as at 26 and accordingly, upon full permissible insertion of the rivet shank through the axial opening 18 of the shell, the rivet head will bear on the outer surface of the shell along a narrow-width band (zone) which is spaced axially from the opening edge (upwardly thereof as seen in FIG. 1).

According to a related feature of the invention, the shank portion of said rivet component 14 whose diameter is otherwise such as permits relatively ready assembly of rivet to the shell, incorporates integral means which is adapted to interlock beneath the circular edge defining the axial opening 18 of the shell component and which is bounded by the aforesaid sharply inwardly-turned annular spring area 20 thereof. More particularly, such shank-provided means according to the FIG. 1 form thereof comprises a full-circular bead or rib 30 formed of the material of the rivet shank preferably in a cold-rolling operation performed thereon and which increases the diameter thereof at a predetermined location along its length which is such that, when the rivet is fully assembled to its shell component (as illustrated in FIG. 1), said enlarged diameter bead or rib 30, after having been forced through the central opening 18 of the shell, will have moved relatively inwardly-axially past the opening edge to a position in which it snaps beneath said edge. At about the same instant that such interlocking action takes place, the chamfered outer edge 26 of the rivet head will be drawn into firm seating engagement with the outer surface of the shell and more particularly along a circular band or zone thereof which is radially opposed to said chamfered outer edge.

Thus, there is achieved a positive interlock between the shell and rivet components of the supporting button which enables same to be handled as a unit without fear of separation of said components or even any slight dislodgement of one with respect to the other in handling and, more importantly, when the rivet is being clinched to the luggage or bag bottom as will be described hereinafter.

While FIG. 1 illustrates a simple form of shank-provided bead or rib capable of interlocking with the central-opening edge of the shell component of a supporting button, other effective forms and shapes of such shank-provided means may be employed. More particularly, FIG. 2 shows in integral collar-form rib 32 which is inclined in the direction of the planar underface of the rivet head, rather than extending outwardly therefrom in true radial direction as in FIG. 1, and FIG. 3 shows the collar-form rib 34 to be inclined in the opposite direction from that shown in FIG. 2.

FIG. 4 illustrates yet another very effective type of bead or rib, such taking the form of one or more closely adjacent, radial tooth-like projections 36.

FIG. 5 illustrates a somewhat more sophisticated type of integral bead or rib comprising but an oversize-diameter length-portion 38 provided on the rivet shank and which is located axially therealong a distance such that when the rivet is forced through the shell-opening 18, the opening edge will first yield and then frictionally lock thereto with a high degree of security.

Finally, FIG. 6 illustrates yet another form or embodiment of shank-provided bead or rib means, such comprising an outwardly bulging, oversize-diameter length-portion 40 extending from approximately the line of the planar underface of the rivet head 16 downwardly to a length-portion 40a having gradually decreasing diameter which is such as to facilitate initial insertion and then continued axial movement of said shank length-portion 40 into locking engagement with the opening edge 18.

Both said oversize diameter length-portions 38 (FIG. 5) and 40 (FIG. 6) may be formed on the rivet shank by cold-rolling same thereon.

According to a further feature of the invention, the difficulty sometimes encountered in starting the bifurcated end of the rivet shank in its movement through an aperture usually provided therefor in the bottom member or wall of the article of luggage, etc., which difficulty has been established to be caused by the diametrical slitting of the shank-end requisite to rivet securement by clinching, also rendering said bifurcated end portion of the shank out-of-round, i.e. non-circular, is overcome simply and effectively by re-shaping the shank portion back to true circularity after it has been slit or bifurcated. Preferably, such re-shaping is effected in a cold-rolling operation which can be and preferably is performed simultaneously with and in the same machine as that employed in cold-rolling the aforementioned rib, bead, tooth and oversize-diameter formations 30–40 on the opposite or head-end portion of the rivet shank.

To insure fast and fool-proof clinching of the bifurcated shank-end of the rivet component of a button as described against the underside or face of the bottom member 12, when such form of button securement has been decided upon and is otherwise determined to be feasible, the invention further provides means as more or less schematically illustrated in FIGS. 7 and 8 for achieving same, i.e. for bending the forks or bifurcations **14*a*, 14*b* of the rivet resulting from the diametrical slitting of its shank-end, in opposite directions against the underside or face of the bottom member or wall 12. More particularly and assuming that the slitted shank-end of the rivet has been manually or mechanically inserted or otherwise placed so as to extend through an aperture provided therefor in said bottom member 12 (or driven directly through the material of said bottom member in manner similar to a nail) and that the shell component 10 is positioned relatively as in FIG. 7, said clinching means illustratively comprises coaxially related rivet-head holding and shank-end bending elements 50, 60 powered by suitable means (not shown) to move, preferably in unison toward and away from one another, the relatively upper rivet-head holding member 50 to a position in which its end face 52, which preferably is formed slightly concave and complementary to the convex upper surface of the rivet head 16, moves against said head, that is to say to a position in which it is adapted to take the axial force or thrust exerted on the rivet by said shank-end bending member 60** as the latter partakes of its relatively upward stroke.

The end face of said member 60 is shown to be formed with a sharply defined, diametrical, ridge formation 62 with which the slit in the shank-end of the rivet will be generally aligned, and with sidewardly extending, concave forming surfaces 64*a*, 64*b* which are adapted when said member is power-actuated relatively upwardly to a position corresponding to that shown in FIG. 8, i.e. against the rivet held immobile by the lowered rivet-head holding member 50, to bend the branches or bifurcations 14*a*, 14*b* relatively outwardly and to an extent such that they lie against the relatively underside or face of the bottom member 12.

During the progress of the aforesaid clinching (bending) operation, the button shell 10 is also held immobile by the action of a light spring force effective on its outer surface and preferably along a circular line disposed well outwardly of the zone or band of contact of the rivet head 16 with the shell outer-surface. More particularly, and as illustrated in FIG. 7, the rivet-head engaging member 50 mounts in encircling relation thereto a coil spring 54 having generally upright-conical configuration, whose lower coils normally extend well below the end face 52 of said rivet-head engaging member 50, and further are of substantially greater diameter than said member proper. Thus, the coil spring 54 is capable of exerting, when compressed axially as in FIG. 8, a light spring force on the shell outer-surface well in advance of the said member 50 moving against the rivet head 16, which serves to stabilize the shell just prior to and during the progress of the clinching operating being applied to the bifurcated end of the rivet shank.

Of course, it is to be clearly understood that the attachment of a supporting button constructed according to my invention to the underside or face of a bottom horizontal or wall member or part, such as that designated 12, by means other than that effecting clinching or spreading-apart of the shank end bifurcations of the rivet component of said button, as herein just described and illustrated, is possible. Also, it is to be understood that whereas FIGS. 1, 7 and 8 illustrate said bottom member or wall as being provided with a pre-drilled or -punched aperture for the reception and placement of the shank end of the rivet component of a button as described, said shank-end may instead be initially placed by being driven through the material of the bottom member, in manner similar to a nail. All such variations when determined to be feasible for a special application are intended to be included within the scope of my present invention as defined in the appended claims.

Having fully disclosed my said invention, I claim thereof the following:

1. A supporting button for attachment to the under side of the bottom wall or member of an article of luggage, a hand-carried case, a golf bag, etc. and being operative to support said bottom wall or member slightly raised from an out of direct contact with a usually horizontal surface on which said article is rested, comprising:

a hollow metal shell having an axial opening and which is adapted to be secured hollow-side-up against the underside of said bottom wall;

said axial opening being defined by a generally circular edge encircled by an annular shell portion which inclines an appreciable distance into the hollow of the shell proper;

a rivet extending through said axial shell opening and comprising a head having a generally planar under face and outer-edge diameter which is substantially greater than that of said axial shell opening and an integral elongate shank extending from said head and having diameter throughout the major portion of its length as measured from its end distal from said head such as permits its ready insertion in and its relatively unimpeded axial movement through said opening;

said shank further including an integral short-length portion having diameter greater than that of said axial shell opening and being located a predetermined axial distance from the rivet head such that upon said short-length portion being forced through said axial shell opening it locks beneath the circular edge defining the same with a snap action and in so doing draws the rivet head into tight engagement with said annular shell portion along a circular line thereof which is spaced axially-outwardly from said circular edge of the axial shell opening.

2. A supporting button according to claim 1, wherein said integral short-length portion of the rivet shank comprises a circular, rib-like formation thereon which projects radially outwardly from the rivet-shank surface.

3. A supporting button according to claim 1, wherein said integral short-length portion of the rivet shank is provided by at least one circular tooth-like formation which projects generally radially outwardly from the rivet shank surface.

4. A supporting button according to claim 1, wherein said integral short-length portion of the rivet shank is provided by a circular collar-like formation which inclines toward the rivet head.

5. A supporting button according to claim 1, wherein said integral short-length portion of the rivet shank is provided by a circular collar-like formation which inclines away from said rivet head.

6. A supporting button according to claim 1, wherein the annular shell portion encircling said axial-opening edge extends as a truncated cone having spring properties enabling passage of the short-length portion of the shank inwardly through said opening but preventing withdrawal movement of the shank.

7. A supporting button according to claim 1, wherein the end portion of the rivet shank opposite the head thereof is transversely slit whereby it may be readily clinched to the said bottom wall of said article of luggage, etc.

8. Means for attaching a supporting button in position against the bottom of an article to be supported slightly raised from a rest surface, wherein said button consists of a hollow metal shell having an axial rivet-receiving opening and a rivet extending through said opening, said rivet having a head whose under-face is planar and which has appreciably greater diameter than that of said opening and an elongate shank incorporating means adjacent said head movably securing said rivet to said shell with a snap action responsive to being forcibly projected through said axial opening and being provided with a diametrically extending slit in its opposite end-forming bifurcations, comprising: coaxially related, normally spaced-apart rivet-head engaging means and bifurcation spreading means and means for actuating the aforesaid means towards one another and against the opposite ends of the rivet, said rivet-head engaging means to a position in which it maintains the rivet immobile against the thrust of the bifurcation-spreading means and the latter means to positions effecting progressive spreading of the bifurcations and thereby clinching of the rivet to the article bottom, said rivet-head engaging means also mounting coil-spring means effective on the external shell surface radially outwardly of the rivet-head circumference for stabilizing the shell during the progress of the aforesaid clinching operation.

* * * * *